US008490701B2

(12) United States Patent
Roane et al.

(10) Patent No.: US 8,490,701 B2
(45) Date of Patent: Jul. 23, 2013

(54) METHODS OF RELEASING AT LEAST ONE TUBING STRING BELOW A BLOW-OUT PREVENTER

(75) Inventors: Thomas O. Roane, Carrollton, TX (US); Andrew D. Penno, Pau (FR); Patrick P. Bourgneuf, Pau (FR)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 13/371,873

(22) Filed: Feb. 13, 2012

(65) Prior Publication Data

US 2012/0247770 A1 Oct. 4, 2012

Related U.S. Application Data

(63) Continuation of application No. PCT/US2011/048784, filed on Aug. 23, 2011.

(60) Provisional application No. 61/470,911, filed on Apr. 1, 2011.

(51) Int. Cl.
*E21B 33/06* (2006.01)
*E21B 33/03* (2006.01)

(52) U.S. Cl.
CPC ..... *E21B 33/06* (2013.01); *E21B 33/03* (2013.01)
USPC ..... 166/297; 166/55; 166/85.4

(58) Field of Classification Search
USPC ..... 166/297, 298, 55, 55.2, 77.51, 85.4
See application file for complete search history.

(56) References Cited

U.S. PATENT DOCUMENTS

| | | | | |
|---|---|---|---|---|
| 3,720,260 | A * | 3/1973 | Duck et al. | 166/336 |
| 4,175,778 | A | 11/1979 | Nunez et al. | |
| 4,886,115 | A | 12/1989 | Leggett et al. | |
| 6,079,494 | A | 6/2000 | Longbottom et al. | |
| 6,186,249 | B1 | 2/2001 | Bjornstad | |
| 2003/0132004 | A1 * | 7/2003 | Suro | 166/380 |

OTHER PUBLICATIONS

Transocean "Well Control HQS-OPS-HB-01 Well control Complications/Emergency" Issue No. 03, revision No. 00, revision date: Mar. 31, 2008 TRN-HCEC-00005542. http://democrats.energycommerce.house.gov/documents/20100512/TRO-Surface.BOP.Operations.From.Floating.Vessels.pdf.*

* cited by examiner

*Primary Examiner* — Cathleen Hutchins
(74) *Attorney, Agent, or Firm* — Paul Herman; Sheri Higgins Law; Sheri Higgins

(57) ABSTRACT

A method of controlling a blowout comprises: releasing at least a first tubing string into a portion of a well system, wherein the step of releasing comprises activating a release table; and causing or allowing a blowout preventer to close. The methods further comprise: compressing at least a portion of a second tubing string and a third tubing string together, wherein the step of compressing comprises activating a crimping device; cutting through the wall of at least a third tubing string, wherein the step of cutting comprises activating a cutting device, and wherein the step of cutting is performed after the step of compressing; and releasing at least the second tubing string and the third tubing string into a portion of a well system, wherein the step of releasing comprises activating a release table.

19 Claims, 13 Drawing Sheets

METHODS OF RELEASING AT LEAST ONE TUBING STRING BELOW A BLOW-OUT PREVENTER

CROSS-REFERENCE TO RELATED APPLICATIONS

This application is a continuation of International Application No. PCT/US11/48784, filed Aug. 23, 2011, and U.S. Provisional Application No. 61/470,911, filed Apr. 1, 2011.

TECHNICAL FIELD

Methods of releasing at least a first tubing string to a point below a blow-out preventer are provided. According to an embodiment, at least the first tubing string is released into a wellbore. More than one tubing string can also be released. The release of the tubing string(s) can be used to assist a blow-out preventer in shutting in a well by reducing or eliminating the number of tubing strings the BOP must cut through when attempting to close.

SUMMARY

According to an embodiment, a method of controlling a blowout comprises: releasing at least a first tubing string into a portion of a well system, wherein the step of releasing comprises activating a release table; and causing or allowing a blowout preventer to close.

According to another embodiment, a method of controlling a blowout comprises: releasing at least a first tubing string into a portion of a well system, wherein the step of releasing comprises activating a release table; cutting through the wall of at least a second tubing string, wherein the step of cutting comprises activating a cutting device; and causing or allowing a blowout preventer to close.

According to yet another embodiment, a method of controlling a blowout comprises: compressing at least a portion of a second tubing string and a third tubing string together, wherein the step of compressing comprises activating a crimping device; cutting through the wall of at least a third tubing string, wherein the step of cutting comprises activating a cutting device, and wherein the step of cutting is performed after the step of compressing; releasing at least the second tubing string and the third tubing string into a portion of a well system, wherein the step of releasing comprises activating a release table, and wherein the step of releasing at least the second and third tubing strings is performed after the step of cutting; and causing or allowing a blowout preventer to close.

BRIEF DESCRIPTION OF THE FIGURES

The features and advantages of certain embodiments will be more readily appreciated when considered in conjunction with the accompanying figures. The figures are not to be construed as limiting any of the preferred embodiments.

DETAILED DESCRIPTION

Figure 1:
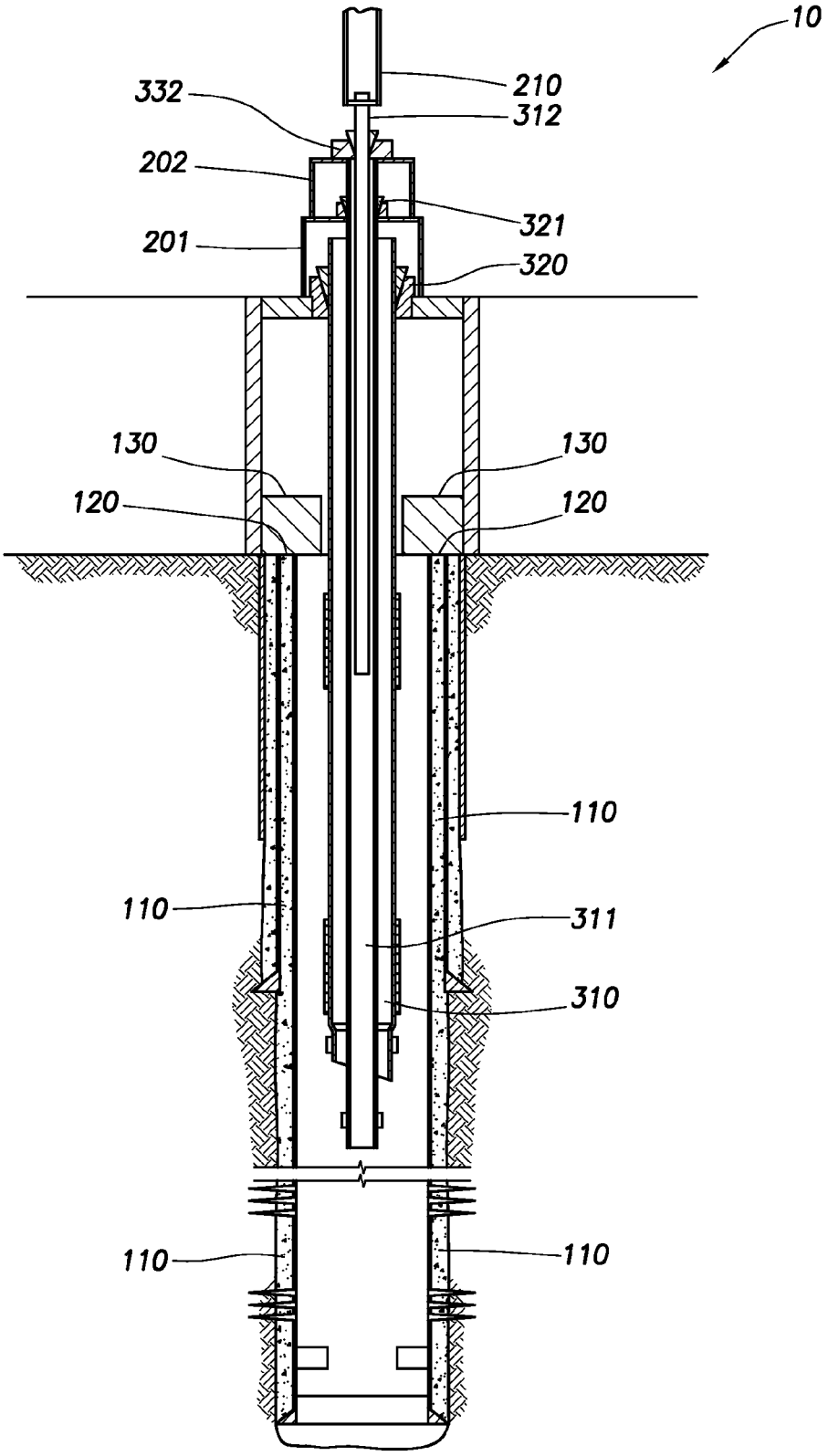
FIG. 1 is a diagram of a well system.

As used herein, the words "comprise," "have," "include," and all grammatical variations thereof are each intended to have an open, non-limiting meaning that does not exclude additional elements or steps.

It should be understood that, as used herein, "first," "second," "third," etc., are arbitrarily assigned and are merely intended to differentiate between two or more tubing strings, steps, etc., as the case may be, and does not indicate any sequence. Furthermore, it is to be understood that the mere use of the term "first" does not require that there be any "second," and the mere use of the term "second" does not require that there be any "third," etc.

Oil and gas hydrocarbons are naturally occurring in some subterranean formations. A subterranean formation containing oil or gas is sometimes referred to as a reservoir. A reservoir may be located under land or off shore. Reservoirs are typically located in the range of a few hundred feet (shallow reservoirs) to a few tens of thousands of feet (ultra-deep reservoirs).

A well system can include multiple components for drilling and producing oil or gas. Some of the components can include a rig floor, a rotary table, and an elevator. In order to produce oil or gas, a wellbore is drilled into a reservoir or adjacent to a reservoir. A wellbore includes a wellhead, which is typically located at ground level for land operations and is typically located at the top of the sea floor for off-shore operations. The rig floor is often located several feet to several thousands of feet above the wellhead. For example, in land operations, the rig floor can be located several feet, commonly anywhere from 10 to 60 feet, above the wellhead at ground level. By way of another example, in off-shore drilling, the rig floor is usually located at the surface of the sea. For off-shore operations, the distance between the rig floor and the wellhead is determined by the depth of seawater from the surface of the sea to the sea floor. It is not uncommon for off-shore rig floors to be located several thousands of feet above the wellhead.

A portion of a wellbore may be an open hole or cased hole. In a cased-hole wellbore portion, a casing string is placed into the wellbore, which can also contain a tubing string. A well can include, without limitation, an oil, gas, water, or injection well. A well used to produce oil or gas is generally referred to as a production well. A wellbore can include vertical, inclined, and horizontal portions, and it can be straight, curved, or branched. As used herein, the term "wellbore" includes any cased, and any uncased, open-hole portion of the wellbore.

After a wellbore has been drilled, the wellbore is then completed. During completion of an open-hole wellbore, a tubing string may be placed into the wellbore. The tubing string allows fluids to be introduced into or flowed from a remote portion of the wellbore. A tubing is a section of tubular pipe, usually 30 feet in length. Examples of a pipe can include, but are not limited to, a blank pipe, a sand screen, or a washpipe. A tubing string refers to multiple sections of pipe connected to each other. A tubing string is created by joining multiple sections of pipe together. This is generally accomplished by picking up a first section of pipe with an elevator. If the section of pipe includes a ring, then the section of pipe can be lowered to a release table. The release table can include a ram that is capable of opening and closing. The ram can be opened or closed via hydraulic pistons. In the closed position, the inner diameter (I.D.) of the ram is less than the outer diameter (O.D.) of the ring of the pipe. In this manner, a section of pipe fitted with a ring can be lowered on top of the closed ram such that the ring rests on top of the ram and the section of pipe is suspended from the release table. The elevator can be released and the pipe is prevented from falling into the wellbore via the ram and ring. A second section of pipe, also fitted with a ring, can now be joined to the first section. This is accomplished be picking up the second section with the elevator. The second section is lowered to an area above the top of the first section. The two sections of pipe are connected to each other via threaded joints. After connection, the ram is opened, the two sections are lowered such that the ring of the first section is located below the ram and the ring of the second section is located slightly above the ram. The ram is closed and the two sections are lowered until the ring of the second section rests on top of the closed ram. This process is repeated until the desired length of tubing string is achieved.

After any tubing string that contains rings is run, a running table can be added to the well system. The running table is generally located above the release table and can include a plate. Any tubing strings that do not include a ring can be run via the running table. This is generally accomplished by picking up a first pipe via the elevator. A collar (also called a collar clamp) is placed near the top of the first pipe. The first pipe is then lowered to the running table via the elevator. The collar on the first pipe rests on top of the plate of the running table. The pipe is released from the elevator and the pipe is prevented from falling into the wellbore via the collar and plate. A second section of pipe is picked up via the elevator and lifted to an area above the first pipe. The two pipes are then connected via threaded joints. The collar is then removed from the first pipe and connected to the second pipe near the top of the pipe. The second pipe is then lowered to the running table and suspended via the collar and plate. The process continues in this fashion until the desired length of tubing string has been run.

After the tubing string is run at the running table to the desired length, the entire tubing string is generally lowered to the release table. The no-ring tubing string (i.e., the second tubing string) can be suspended from the release table by suspending the second tubing string from the ringed tubing string (i.e., the first tubing string). This can be accomplished via a slip, a bowl, or a no-go sub assembly. The O.D. of the slip, bowl, or sub assembly should not be greater than the O.D. of the first tubing string. In this manner, the second tubing string sits on top of the first tubing string and is suspended from the first tubing string. Both strings are suspended from the release table via the ram. The no-go sub assembly can include multiple components for suspending one tubing string from another tubing string. By way of example, the sub assembly can include a protector component that prevents damage to the first tubing string. By suspending the second tubing string from the first tubing string, the running table is available to run a third tubing string and so on.

A common completion technique for an open-hole wellbore is called sand control. During sand control, a string of sand screen pipes (which often include sections of blank pipe) is run into the wellbore. A sand screen and blank pipe usually include a ring on each section of pipe. As used herein, the present sense of the term "run," and all grammatical variations thereof, means the process of connecting sections of pipe together to form a tubing string. After the sand screen string has been run and suspended from the release table, a new tubing string that does not include rings is run inside the sand screen string via the running table and into the wellbore. As used herein, the past sense of the term "run," and all grammatical variations thereof, means a tubing string that has already been placed in the wellbore. It is common for the new tubing string to be a washpipe. Tubing strings used in sand control can include a sand screen string (commonly 5½ inches in diameter, but may be any size), a first washpipe (commonly 4 inches in diameter when used with a 5½ inch screen), and optionally a second washpipe (commonly 2⅞ inches in diameter when used with a 4 inch first washpipe).

Several problems can arise during the drilling and/or completion process. One problem is the occurrence of a formation kick. A kick can occur when the fluid (e.g., a liquid or a gas) in a reservoir prematurely enters a portion of the wellbore, for example, in an annular space of the wellbore. Prior to production, a sufficient hydrostatic pressure must be exerted on the subterranean formation in order to prevent the formation fluids from prematurely entering the wellbore. Hydrostatic pressure is the pressure exerted by a fluid at equilibrium due to the force of gravity. If the hydrostatic pressure exerted by the fluid is not great enough, then a kick could occur.

A common first response to detecting a kick would be to isolate the wellbore from the surface and try to shut in the well. If the well is not shut in, then a blowout could occur. A blowout is the uncontrolled release of crude oil and/or natural gas from a well after pressure control systems have failed. Traditional pressure control systems include the use of one or more blowout preventers (BOP). A BOP can be a ram-type BOP or an annular BOP. A ram-type BOP is commonly located at the wellhead, which is located at the surface of land or at the surface of a subsea floor. There are several types of ram BOPs. Some ram BOPs are used when there is not a tubing string located within the area of the wellhead and other ram BOPs are used when there is a tubing string located within the area of the wellhead. For example, a shear ram can cut through a tubing string via hardened steel shears. A blind shear ram (also known as a shear seal ram, or a sealing shear ram) is intended to seal a wellbore, even when the wellbore is occupied by a tubing string, by cutting through the tubing string as the ram closes off the well. The upper portion of the severed tubing string is freed from the ram, while the lower portion may be crimped and the "fish tail" captured to hang the tubing string off the BOP.

It is not uncommon for a BOP to fail, which can result in a blowout of a well. An example of a potential failure is when there are multiple tubing strings or screens that a shear ram BOP must cut through before the wellbore can be sealed. It can be difficult at best, or impossible at worst, for a shear ram to effectively cut through two or more tubing strings or screens and/or seal when the strings or screens are being run. Even if a shear ram BOP is able to partially cut through more than one tubing string or screen, the BOP may not completely seal the wellbore due to the remaining un-cut pipe and/or screen.

The largest underwater blowout in U.S. history occurred on Apr. 20, 2010, in the Gulf of Mexico at the Macondo Prospect oil field. One of the causes of the blowout was the failure of a shear ram BOP to seal the wellbore. The blowout caused the explosion of the Deepwater Horizon, an off-shore drilling rig. The explosion killed several workers and injured numerous others. Due to the ensuing fire on the rig, the rig had to be evacuated. Workers were no longer able to try and contain the blowout due to the evacuation.

Thus, there is a need for a safety system that can be used in conjunction with a blowout preventer to shut in a well in emergency situations. A novel method of controlling a blowout utilizes releasing at least one tubing string such that the tubing string is no longer located in the area of a BOP. According to certain embodiments, the methods include crimping at least two tubing strings together before releasing the tubing strings. According to other embodiments, the methods include cutting through at least one tubing string before releasing the tubing string(s). One advantage to the methods is that a shear ram BOP may not have to cut through any tubing strings, or it does not have to cut through as many tubing strings in order to seal off the well. By eliminating, or at least reducing, the cutting of tubing strings by the BOP, the BOP can more effectively shut in a well.

According to an embodiment, a method of controlling a blowout comprises: releasing at least a first tubing string into a portion of a well system, wherein the step of releasing comprises activating a release table; and causing or allowing a blowout preventer to close.

According to another embodiment, a method of controlling a blowout comprises: releasing at least a first tubing string into a portion of a well system, wherein the step of releasing comprises activating a release table; cutting through the wall of at least a second tubing string, wherein the step of cutting comprises activating a cutting device; and causing or allowing a blowout preventer to close.

According to yet another embodiment, a method of controlling a blowout comprises: compressing at least a portion of a second tubing string and a third tubing string together, wherein the step of compressing comprises activating a crimping device; cutting through the wall of at least a third tubing string, wherein the step of cutting comprises activating a cutting device, and wherein the step of cutting is performed after the step of compressing; releasing at least the second tubing string and the third tubing string into a portion of a well system, wherein the step of releasing comprises activating a release table, and wherein the step of releasing at least the second and third tubing strings is performed after the step of cutting; and causing or allowing a blowout preventer to close.

Any discussion of a particular component of the well system 10 (e.g., an activation device) is meant to include the singular form of the component and also the plural form of the component, without the need to continually refer to the component in both the singular and plural form throughout. For example, if a discussion involves "the activation device," it is to be understood that the discussion pertains to one activation device (singular) and two or more activation devices (plural). It is also to be understood that any discussion of a particular component or particular embodiment regarding a component is meant to apply to all of the method embodiments without the need to re-state all of the particulars for each method embodiment.

It is to understood that any discussion regarding suspension of a tubing string from the release table can be accomplished by a variety of mechanisms including, but not limited to, a ring, a slip, a bowl, a no-go sub assembly, or combinations thereof. Moreover, two or more tubing strings can be suspended from the release table by first suspending a first tubing string to the release table via one mechanism (e.g., a ring) and then suspending a second tubing string from the first tubing string via another mechanism (e.g., a slip, bowl, or no-go sub assembly). It is also to be understood that any discussion regarding suspension of a tubing string from the running table can be accomplished by a variety of mechanisms including, but not limited to, a collar and a plate.

Turning to the Figures, FIG. 1 depicts a well system 10. The well system 10 can include a wellbore 110 and a blowout preventer (BOP) 130. As can be seen in FIG. 1, it is common for the wellbore 110 to be several hundreds of feet deeper than the total length of the longest tubing string. The BOP 130 can be located at the wellhead 120. The well system 10 can also include a second BOP (not shown). According to an embodiment, the BOP 130 seals off the wellbore 110 at the wellhead 120 by the movement of two shears towards each other such that the two shears eventually close together. For example, the BOP 130 can be a shear ram BOP or a blind shear ram BOP.

The well system 10 can be a producing oil, gas, or water well, or an injection well. The well system 10 can be used for drilling operations, work-over operations, or completion operations. The well system 10 can include a rig floor 200. The rig floor 200 can include a rotary table. The well system 10 can also include a release table 201, a running table 202, and an elevator 210.

The well system 10 can include a first tubing string 310. According to an embodiment, the first tubing string 310 includes sections of pipe, wherein each section of pipe includes a ring. The well system 10 can include anywhere from one to five tubing strings. An example of the first tubing string 310 is a screen and/or blank pipe assembly. A common diameter for a screen and/or blank pipe assembly is 5½ inches. The well system 10 can also include a second tubing string 311 and can also include a third tubing string 312. The second tubing string 311, the third tubing string 312, and any additional tubing strings can include sections of pipe that do not include a ring. For example, the second and third tubing strings 311/312 can be a washpipe. Common diameters for a washpipe are 4 inches and 2⅞ inches. According to an embodiment, the third tubing string 312 is positioned inside the second tubing string 311, and the second tubing string 311 is positioned inside the first tubing string 310. The first tubing string 310 can be suspended from the release table 201 via a ring, a first slip, bowl, or block assembly 320. The second tubing string 311 can be suspended from the running table 202 via a second safety collar and plate 331. After running, the second tubing string 311 can be suspended from the first tubing string 310 at the release table 201 via a second slip, bowl, or no-go sub assembly 321. The third tubing string 312 can be suspended from the running table 202 via a third safety collar and plate 332. After running, the third tubing string 312 can be suspended from the second tubing string 311 at the release table 201 via a third slip, bowl, or no-go sub assembly 322.

The methods include the step of releasing at least a first tubing string 310 into the wellbore 110, wherein the step of releasing comprises activating the release table 201. The step of releasing at least the first tubing string 310 can be opening a ram of the release table 201 via hydraulic pistons. The methods are designed to be used at various points in the tubing string running process. For example, if the first tubing string 310 is in the process of being run and it becomes necessary to shut in the well, then the methods can further include the step of suspending the first tubing string 310 from the release table 201 prior to the step of releasing. The step of suspending can include any or all of the following steps. Lower the elevator 210, set the first tubing string 310 onto the ram via the ring, first slip, bowl, or block assembly 320, and releasing the first tubing string 310 from the elevator 210. Now, when the release table 201 is activated, the first tubing string 310 can fall below the BOP 130 into the wellbore 110. In this manner, the BOP 130 would not have to cut through a tubing string in order to seal the wellbore 110.

By way of another example, if the first tubing string 310 has already been run and the second tubing string 311 is currently in the process of being run, then the first tubing string 310 will already be suspended from the release table 201 via the ring, first slip, bowl, or block assembly 320, and at least a portion of the second tubing string 311 can be attached to the elevator 210, or the second tubing string 311 can be suspended from the running table 202 via the second safety collar and plate 331. In the event it becomes necessary to shut in the wellbore 110, then the first tubing string 310 can be released from the release table 201. When the first tubing string 310 is released, the first tubing string 310 can fall below the BOP 130 into the wellbore 110. In this manner, when the BOP 130 is activated, the BOP 130 only has to cut through the second tubing string 311 instead of having to cut through both, the first and the second tubing strings 310 and 311. This helps to ensure that the BOP 130 will function properly to shut in the wellbore 110, and ideally prevent a blowout. By way of yet another example, if the second tubing string 311 is being run and it becomes necessary to shut in the well, then the methods can further include the step of indirectly suspending the second tubing string 311 from the release table 201 prior to the step of releasing. As used herein, the phrase "indirectly suspending" means a tubing string is suspended from another tubing string, wherein the other tubing is directly suspended from the release table 201, for example, via the ram. The step of indirectly suspending the second tubing string 311 can include any or all of the following steps. Lower the elevator 210 to the release table 201, set the second tubing string 311 in the second slip, bowl, or no-go sub assembly 321, and release the second tubing string 311 from the elevator 210. In this manner, the second tubing string 311 is suspended from the first tubing string 310 and indirectly suspended from the release table 201. Now, when the release table 201 is activated, both the first and the second tubing strings 310 and 311 can fall below the BOP 130 into the wellbore 110. As such, the BOP 130 will not have any tubing strings to cut through when closing.

The step of releasing can further include releasing at least two tubing strings into the wellbore 110. For example, if the first tubing string 310 and the second tubing string 311 have already been run and the third tubing string 312 is in the process of being run, then the first and the second tubing strings 310 and 311 can be suspended from the release table 201 via the ring, first slip, bowl, or block assembly and the second slip, bowl, or no-go sub assembly 320/321. The methods can further include the step of indirectly suspending the second tubing string 311 from the release table 201 after the second tubing string 311 has been run. In the event it becomes necessary to shut in the wellbore 110, then the release table 201 can be activated such that the first and the second tubing strings 310 and 311 fall below the BOP 130 into the wellbore 110. In this manner, the BOP 130 only has to cut through the third tubing string 312 instead of having to cut through all three tubing strings. Again, this helps to ensure that the BOP 130 will function properly to shut in the wellbore 110, and ideally prevent a blowout. Of course, the third tubing string 312 can also be indirectly suspended from the release table 201 in the same manner as the second tubing string 311. Upon activation of the release table 201, all three tubing strings can fall below the BOP 130.

The step of activating the release table 201 can include manually activating a binary activation device (not shown). Examples of the activation device include, but are not limited to, a toggle switch or a push-button switch. Any of the activation devices (e.g., to activate the release table, the crimping device, or the cutting device) can be located near the rig floor 200 or located at a remote location away from the rig floor 200. There can also be two activation devices. One of the activation devices can be located near the rig floor 200 and the other device can be located at the remote location away from the rig floor 200. One of the advantages to having an activation device located away from the rig floor 200 is that the device can be activated at a safe distance away from the rig floor 200. For example, if the workers on the rig are injured to such an extent that they are incapable of manually activating the activation device near the rig floor, then a worker at the remote location can manually activate the activation device. The activation device can include a safety mechanism whereby it is extremely difficult or impossible to accidentally activate the activation device. For example, the activation device can include a cover or a key slot. In the first example, the cover would have to be lifted in order to manually activate the activation device. In the second example, a corresponding key would have to be inserted into the key slot, and the key would have to be rotated in order to manually activate the activation device.

As can be seen in FIGS. 2A through 3B, 6A and 6B, the well system 10 can further include a crimping device 301. The crimping device 301 can be designed such that it is capable of compressing a portion of at least two tubing strings together. According to an embodiment, the crimping device 301 does not cut through the walls of the tubing strings, but rather squeezes the walls of at least two tubing strings to the point where the tubing strings are compressed together. In this manner, the at least two tubing strings are connected to each other at the compression point. The crimping device 301 can be made of a variety of materials including, but not limited to, tungsten carbide, P-110 alloy, and hardened steel.

Figure 2A:
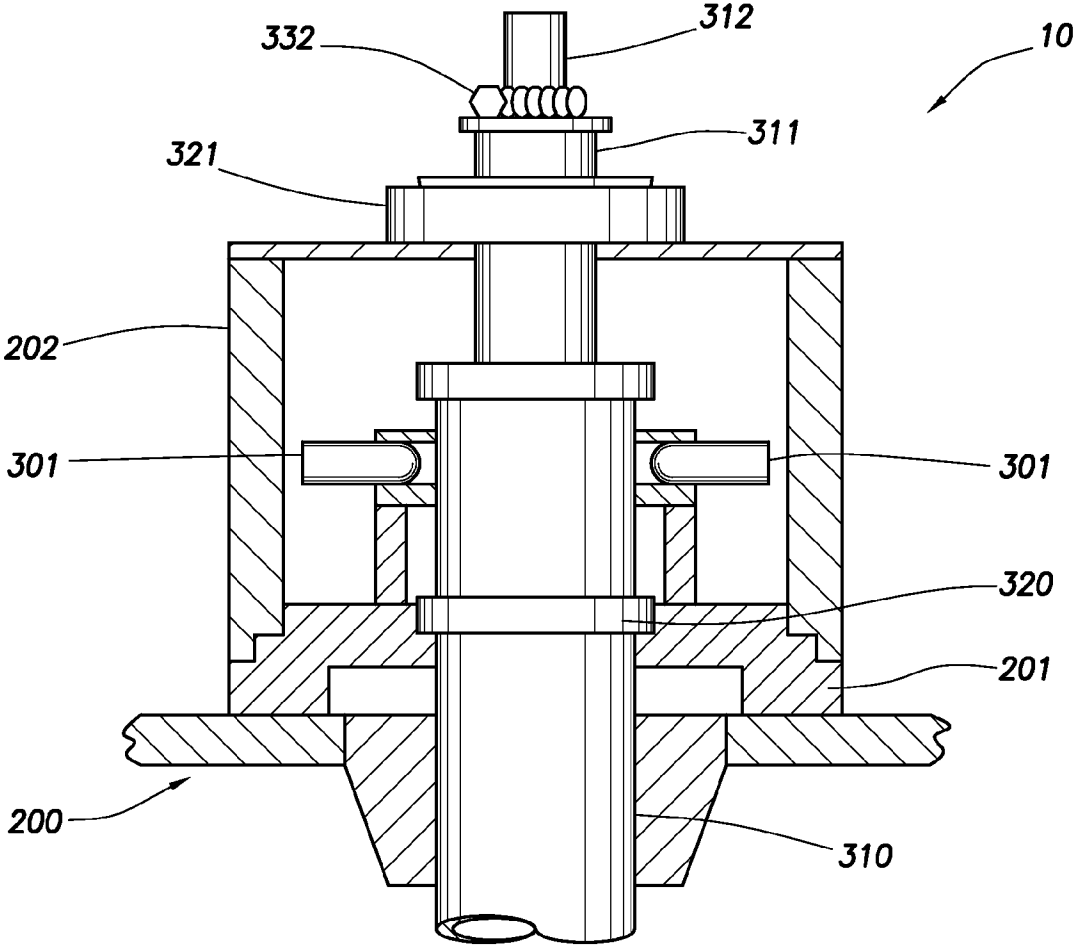
FIGS. 2A and 2B depict the well system further including a crimping device positioned below the top of a first tubing string.
Figure 2B:
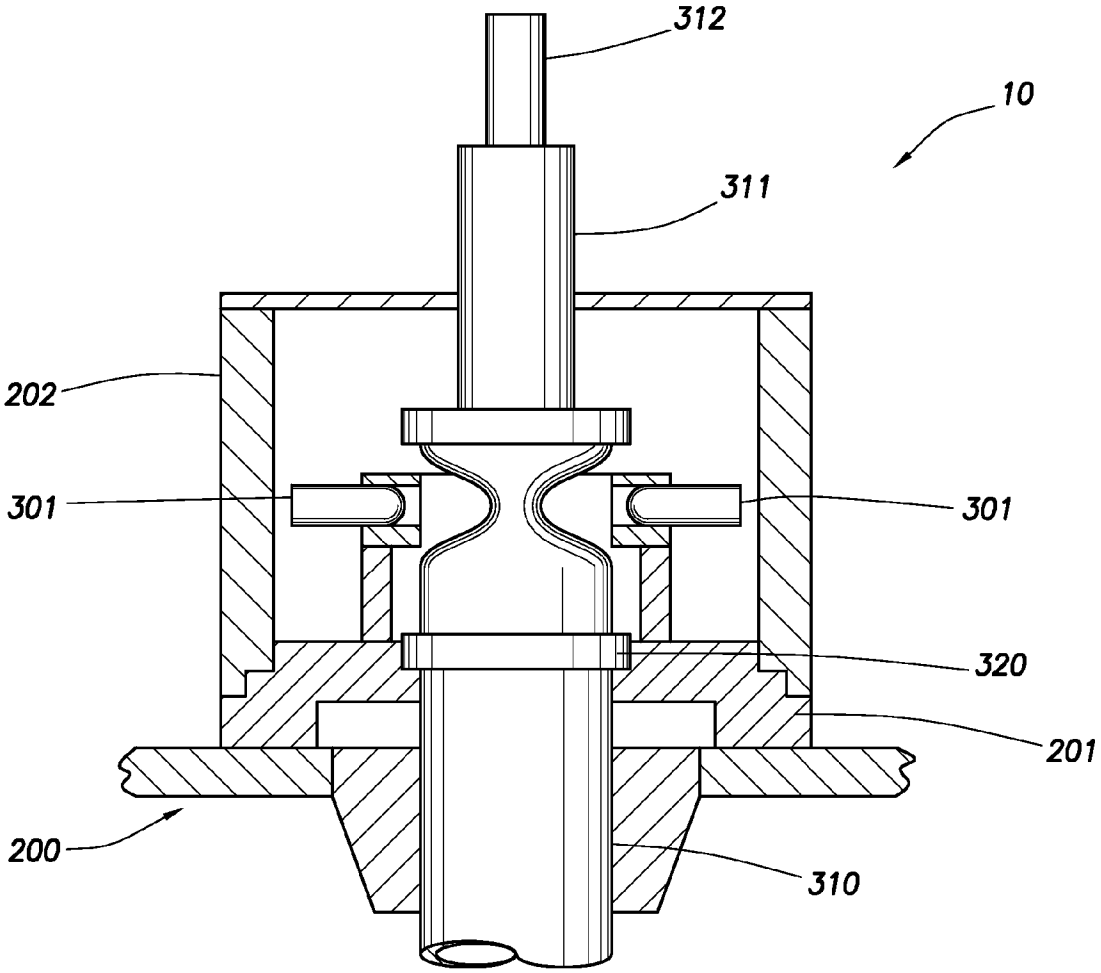

The methods can include the step of compressing at least a portion of two or more tubing strings together, wherein the step of compressing includes activating the crimping device. The crimping device 301 can be positioned below the top of the first tubing string 310, as shown in FIGS. 2A and 2B. According to this embodiment, the step of compressing can include compressing at least the first tubing string 310 and the second tubing string 311 together. The crimping device 301 can be used when there is more than one tubing string being run. Although shown with three tubing strings, the crimping device 301 can be used with only two tubing strings, or with four or more tubing strings. The step of compressing can be performed prior to the step of releasing at least the first tubing string or it can be performed after the step of releasing. If the step of activating the crimping device 301 is performed after the step of releasing at least the first tubing string, then the methods can further include the step of releasing at least a second tubing string. The step of releasing at least the second tubing string can be performed after the step of activating the crimping device 301. The crimping device 301 can be activated using a first activation device. If only one activation device is used, then the sequence of activation can be programmed into the device. For example, the activation device can be programmed to release any tubing strings suspended from the release table 201 first and then activate the crimping device 301 and/or a cutting device 302 or vice versa. The activation device can also be programmed such that there is a delay between the first activation and a second activation. The crimping device 301 can also be activated using a second binary activation device. If the well system 10 also includes a second activation device, then the second activation device(s) can be located adjacent to the first activation device(s) (i.e., near the rig floor 200 or at a remote location away from the rig floor 200), or at a different location from the first activation device. In this manner, the first and second activation devices can be manually activated at the same location. The second activation device can also include a safety feature to limit or prevent accidental activation of the second activation device (e.g., a safety cover or a key slot).

The following examples illustrate the possible methods of using the crimping device 301 as shown in FIGS. 2A and 2B. If the first tubing string 310 has been run and the second tubing string 311 is being run and it becomes necessary to shut in the well, then any or all of the following steps can be performed. Stop running the second tubing string 311, manually activate the crimping device 301, release the crimping device 301, remove the second safety collar or plate 331, install the second slip, bowl, or no-go sub assembly 321 to the top portion of the second tubing string 311, set the second tubing string 311 down onto the first tubing string 310 at the location of the release table 201, and remove the elevator 210 from the second tubing string 311. As can be seen in FIG. 2B, at least the first and the second tubing strings 310 and 311 are compressed together. The first and the second tubing strings 310 and 311 can now be released from the release table 201 via the activation device. Both of the tubing strings can fall below the BOP 130 into the wellbore 110. As a result, the BOP 130 does not have to cut through any tubing strings during closing.

By way of another example, if the first and the second tubing strings 310 and 311 have already been run and the third tubing string 312 is in the process of being run, then any or all of the following steps can be performed. Stop running third tubing string 312, manually activate the crimping device 301, release the crimping device 301, remove the second slip, bowl, or no-go sub assembly 321, remove the third safety collar or plate 332, set the third tubing string 312 down onto the release table 201, and remove the elevator 210 from the third tubing string 312. As can be seen in FIG. 2B, the first, second, and third tubing strings 310, 311, and 312 are compressed together. All three of the tubing strings can now be released from the release table 201 via the activation device. The tubing strings can fall below the BOP 130 into the wellbore 110.

By way of yet another example, the first tubing string 310 can be released from the release table 201 via activation of the activation device, the crimping device 301 can then be activated (which compresses the second and third tubing strings 311 and 312 together), any of the aforementioned steps can be performed, and then the second and third tubing strings 311 and 312 can be released from the release table 201 via activation of the activation device. Of course the crimping device 301 can be used in situations in which there are more than three tubing strings, following the same procedures as outlined above.

Figure 3A:
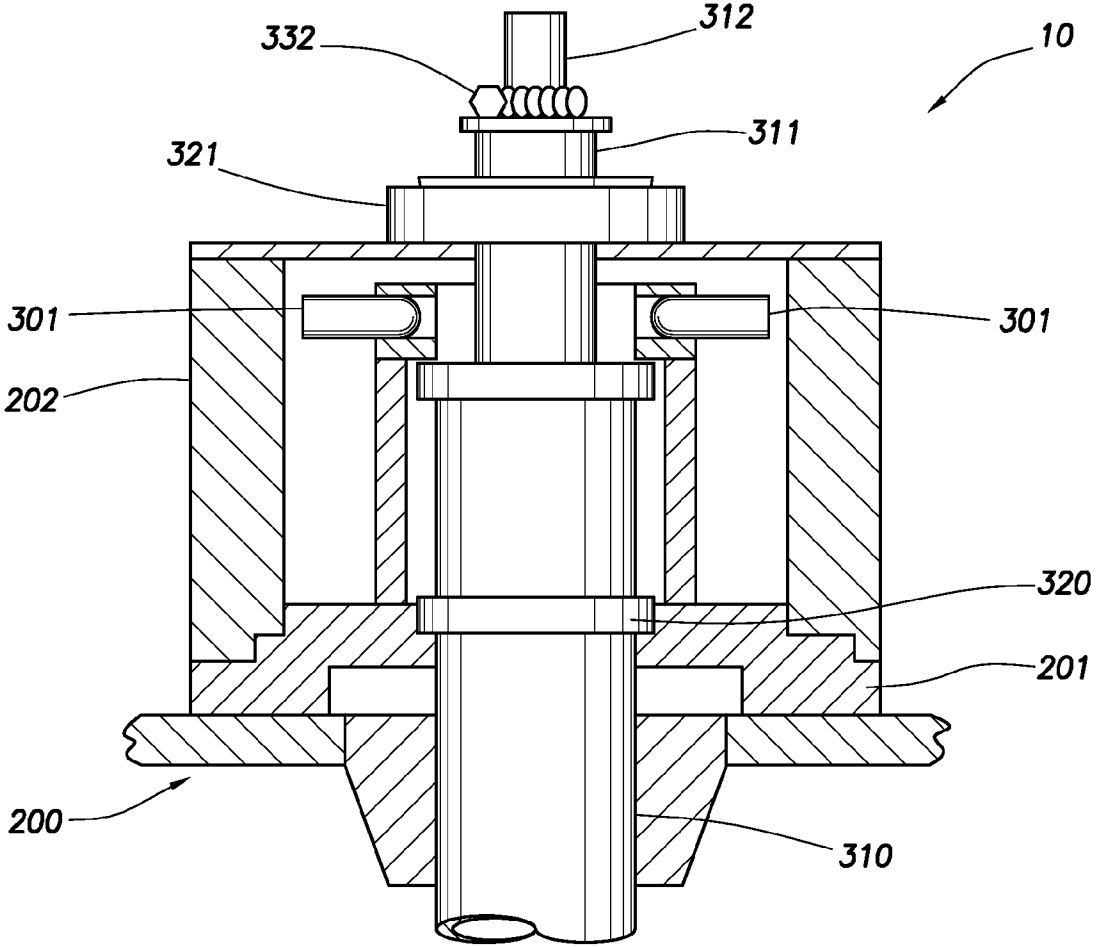
FIGS. 3A and 3B depict the well system with the crimping device positioned between a release table and a running table.
Figure 3B:
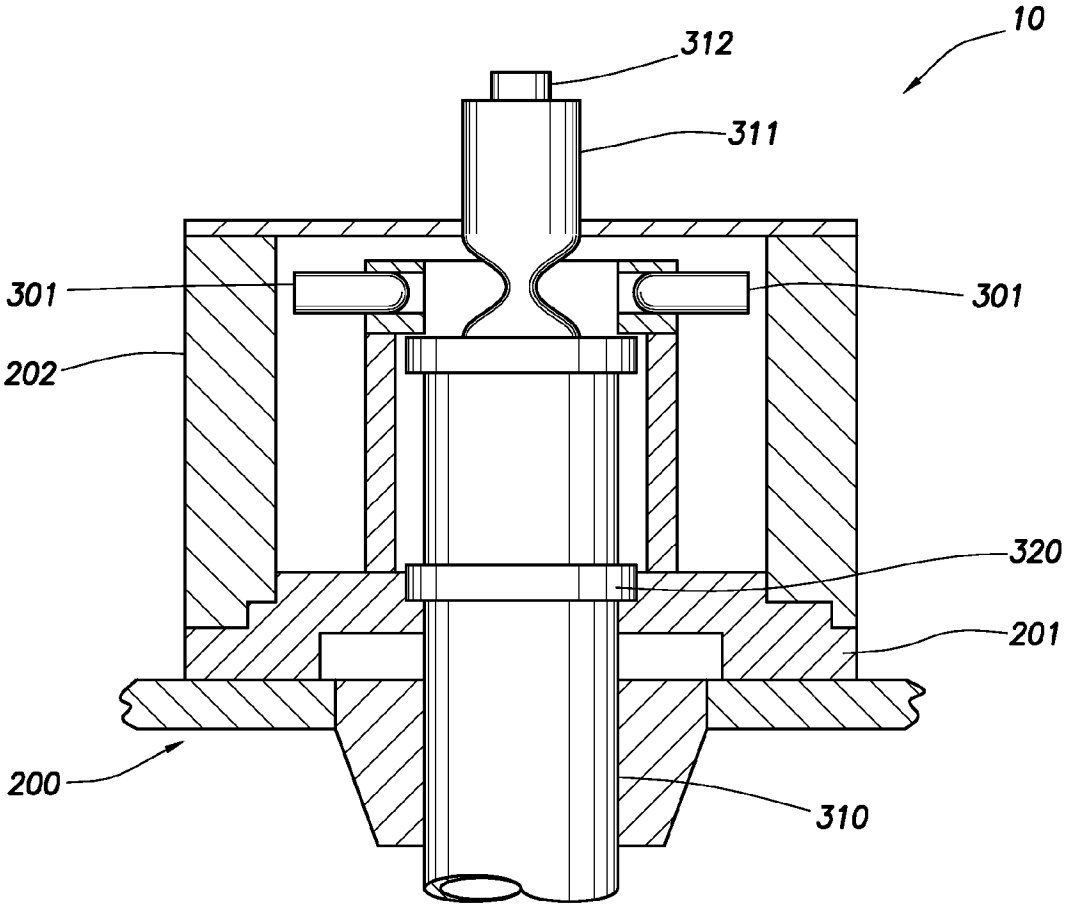

Turning to FIGS. 3A and 3B, the crimping device 301 can be located above the top of the first tubing string 310 at a location between the release table 201 and the running table 202. According to this embodiment, the step of compressing can include compressing at least the second and third tubing strings 311 and 312 together. According to this embodiment, any or all of the following steps can be performed. The first tubing string 310 can be released from the release table 201 and allowed to fall into the wellbore 110, the crimping device 301 is activated and then released to compress the second and third tubing strings 311 and 312 together, the second slip, bowl, or no-go sub assembly 321 is removed, the third safety collar or plate 332 is removed, the third tubing string 312 is set down onto the release table 201, the elevator 210 is removed from the third tubing string 312, and the second and third tubing strings 311 and 312 are released from the release table 201. The second and third tubing strings 311 and 312 can now fall below the BOP 130 into the bottom of the wellbore 110. Again, the BOP 130 does not have to cut through any tubing strings during closing. This method can be used to compress and release four or more tubing strings. If there are four of more tubing strings, then one of skill in the art can determine which tubing strings can be released prior to compression, which tubing strings to compress together, and which compressed tubing strings to release after compression.

According to an embodiment, a method of controlling a blowout comprises: releasing at least a first tubing string into a portion of a well system, wherein the step of releasing comprises activating a release table; cutting through the wall of at least a second tubing string, wherein the step of cutting comprises activating a cutting device; and causing or allowing a blowout preventer to close.

The well system 10 can further include a cutting device 302. The methods can further include the step of cutting through the wall of at least the second tubing string 311, wherein the step of cutting comprises activating the cutting device 302. The cutting device 302 can be designed such that it is capable of cutting through at least one wall of a tubing string. Preferably, the cutting device 302 is designed such that it is capable of completely cutting through the entire wall circumference of at least one tubing string. More preferably, the cutting device 302 is designed such that it is capable of completely cutting through the entire wall circumference of at least two or more tubing strings. The cutting device 302 can be made of a variety of materials including, but not limited to, tungsten carbide, P-110 alloy, and hardened steel. According to an embodiment, the cutting device 302 is made from a material such that the cutting device 302 is capable of completely cutting through two or more tubing strings. Preferably, the cutting device 302 is capable of completely cutting through the two or more tubing strings such that the top portions of the tubing strings are completely severed from the bottom portions of the tubing strings. Reference to the top portion of a tubing string refers to the part of the tubing string located above the cutting device 302 and the bottom portion refers to the part of the tubing string located below the cutting device 302.

Figure 4A:
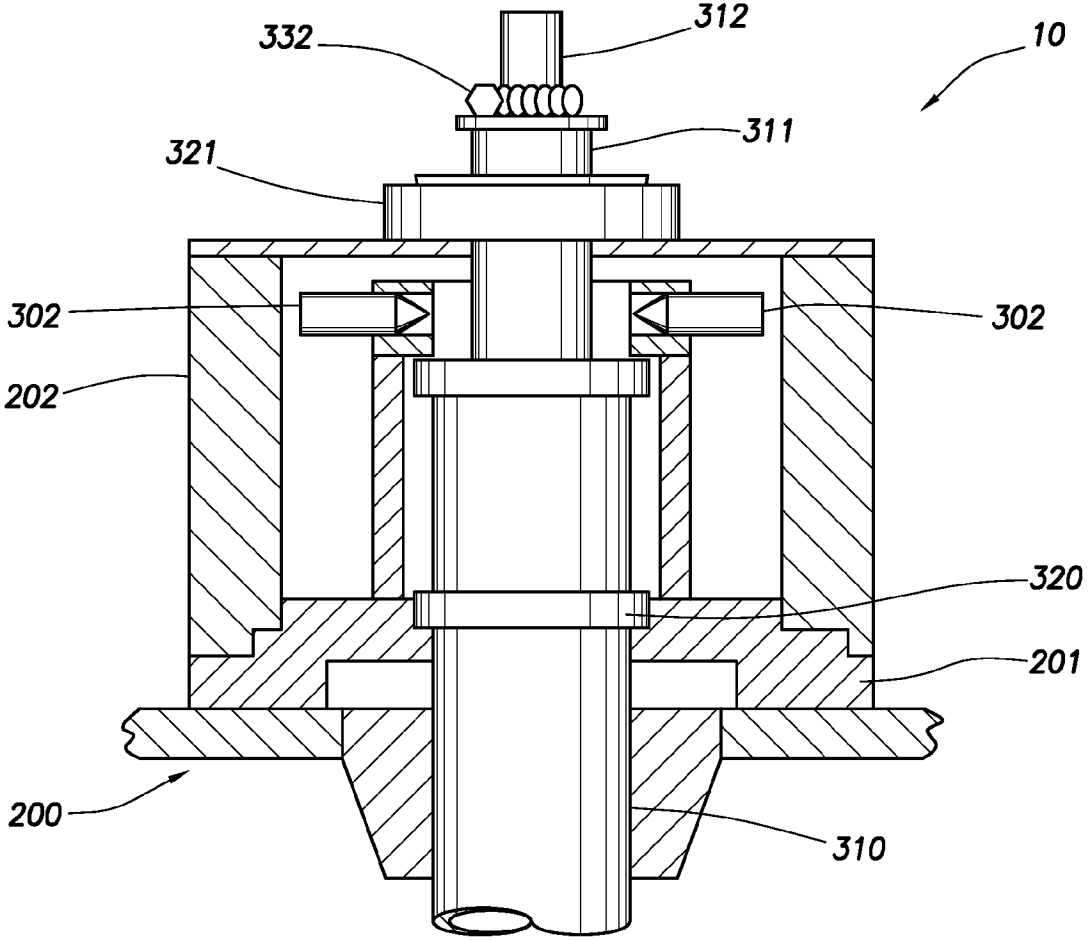
FIGS. 4A and 4B depict the well system further including a cutting device positioned between the release table and the running table.
Figure 4B:
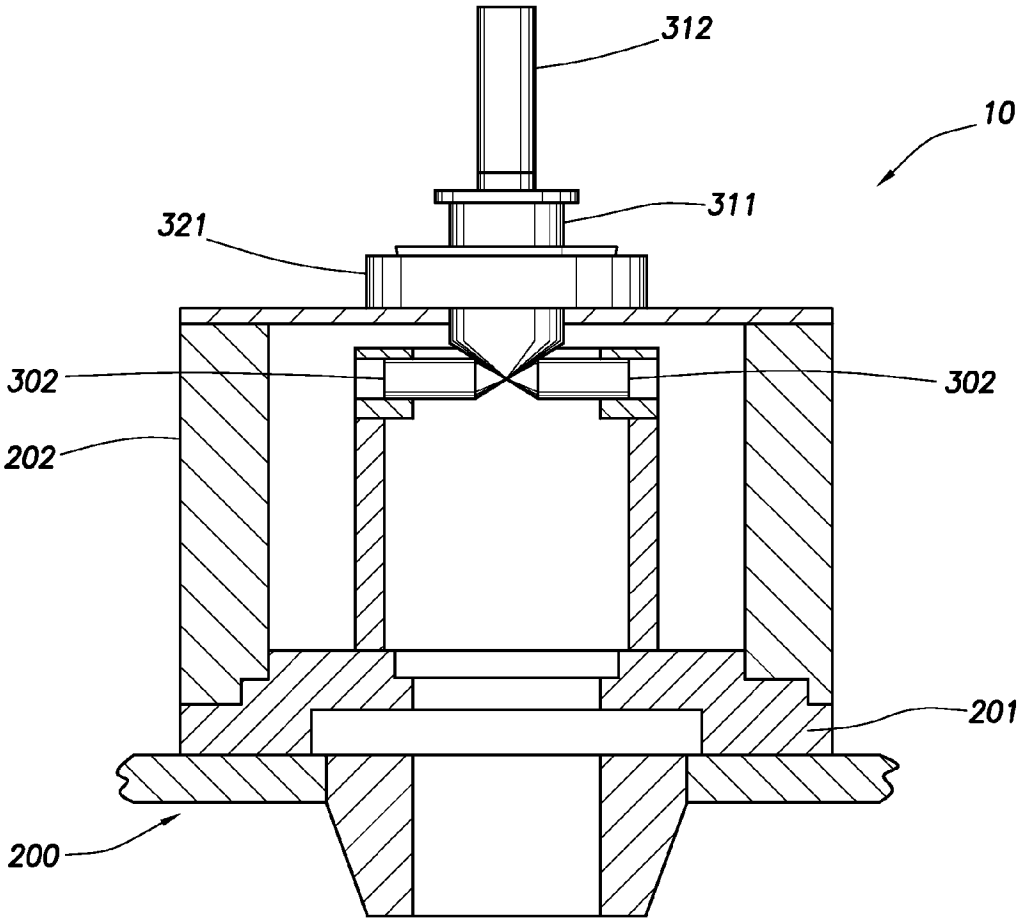

The cutting device 302 can be part of a cutting table 300. The cutting table 300 can be removably attached to the running table 202. The cutting table 300 can be removably attached to the running table 202 at various times in the process of running a tubing string(s). For example, after running the first tubing string 310, the cutting table 300 can be removably attached to the running table 202. The cutting table 300 can also be removably attached after the second tubing string 311 has been run. As can be seen in FIGS. 4A and 4B, the cutting device 302 can be positioned above the top of the first tubing string 310 at a location between the release table 201 and the running table 202. Although FIGS. 4A and 4B depict three tubing strings, the cutting device 302 can be also used with only two tubing strings or four or more tubing strings. According to another embodiment and as can be seen in FIGS. 5A through 5D, the cutting device 302 can be located above the running table 202. The following discussion regarding the cutting device 302 is meant to apply to all the method embodiments that include the cutting device 302 regardless of the exact location of the cutting device 302.

The step of cutting can be performed before the step of releasing at least the first tubing string or it can be performed after the step of releasing at least the first tubing string. The methods can further include the step of releasing at least a second tubing string after the step of releasing at least the first tubing string. The step of cutting can also be performed after the step of releasing at least the first tubing string and before the step of releasing at least the second tubing string. The cutting device 302 can be activated using the first or second activation device.

The following examples illustrate the possible methods of using the cutting device 302. If the first tubing string 310 has been run and the second tubing string 311 is being run and it becomes necessary to shut in the well, then any or all of the following steps can be performed. Stop running the second tubing string 311 and manually activate the cutting device 302. According to this embodiment, when the cutting device 302 is activated, then preferably the cutting device 302 severs the second tubing string 311 such that the second tubing string 311 falls below the BOP 130 into the wellbore 110. The BOP 130 can then be used to cut through the first tubing string 310 upon closure. Alternatively, either before or after the cutting device 302 has been activated and the second tubing string 311 falls below the BOP 130, the first tubing string 310 can be released from the release table 201 such that the BOP 130 does not have to cut through any tubing strings upon closure.

In another embodiment, the cutting device 302 is used to cut through two or more tubing strings. According to this embodiment, the step of cutting comprises cutting through the wall of at least the second and third tubing strings 311 and 312. This may be useful when three or more tubing strings are being run. For example, and as shown in FIGS. 4A and 4B, if the first and the second tubing strings 310 and 311 have been run and the third tubing string 312 is being run, then the cutting device 302 can be used to cut through the second and third tubing strings 311 and 312. According to this embodiment, when the cutting device 302 is activated, the cutting device 302 preferably severs the second and third tubing strings 311 and 312 such that the second and third tubing strings 311 and 312 fall below the BOP 130 into the wellbore 110. The BOP 130 can then be used to cut through the first tubing string 310 upon closure. Alternatively, either before or after the cutting device 302 has been activated and the second and third tubing strings 311 and 312 fall below the BOP 130, the first tubing string 310 can be released from the release table 201 such that the BOP 130 does not have to cut through any tubing strings upon closure.

Figure 5A:
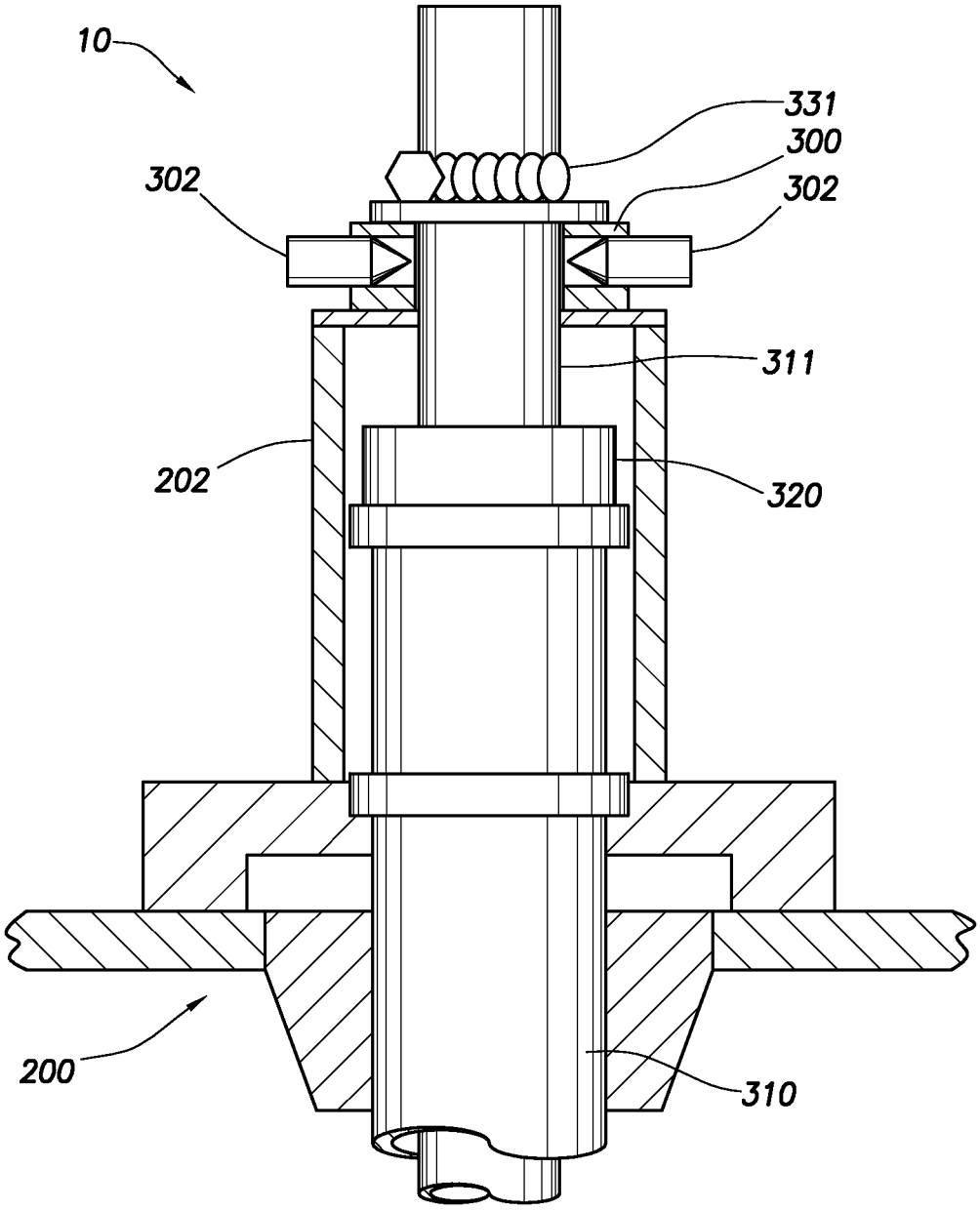
FIGS. 5A through 5D depict the cutting device located on a cutting table positioned above the running table.
Figure 5B:
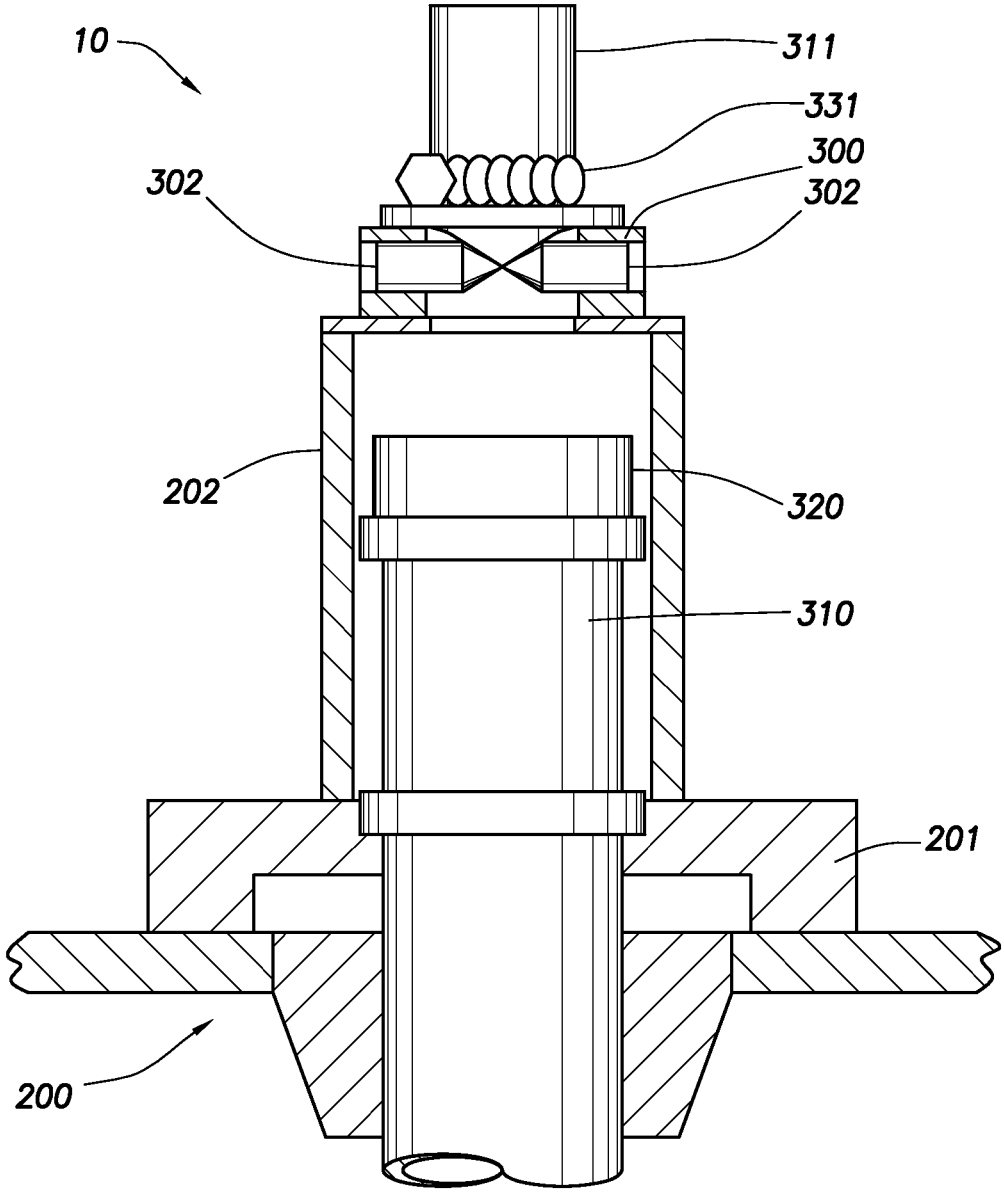
Figure 5C:
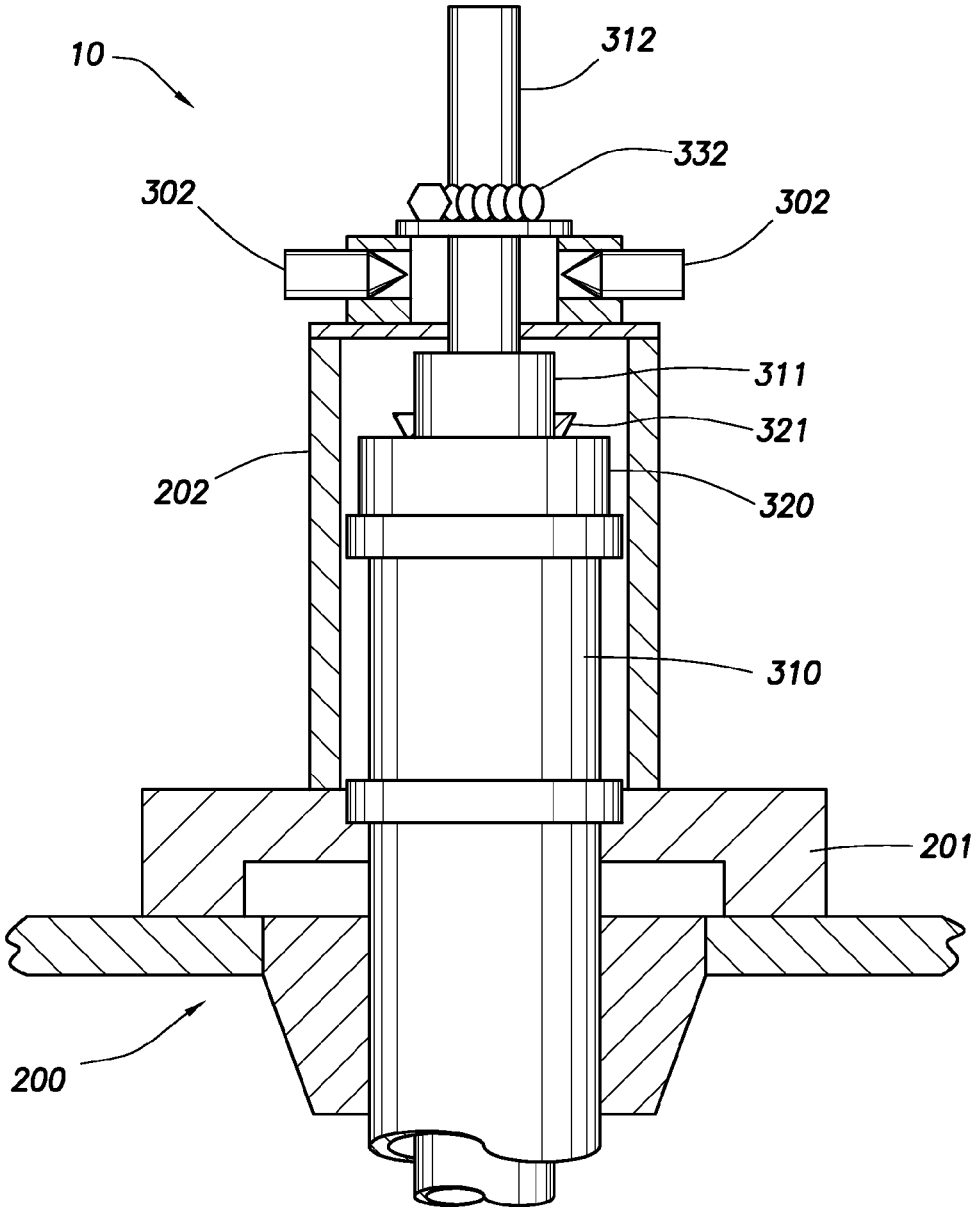
Figure 5D:
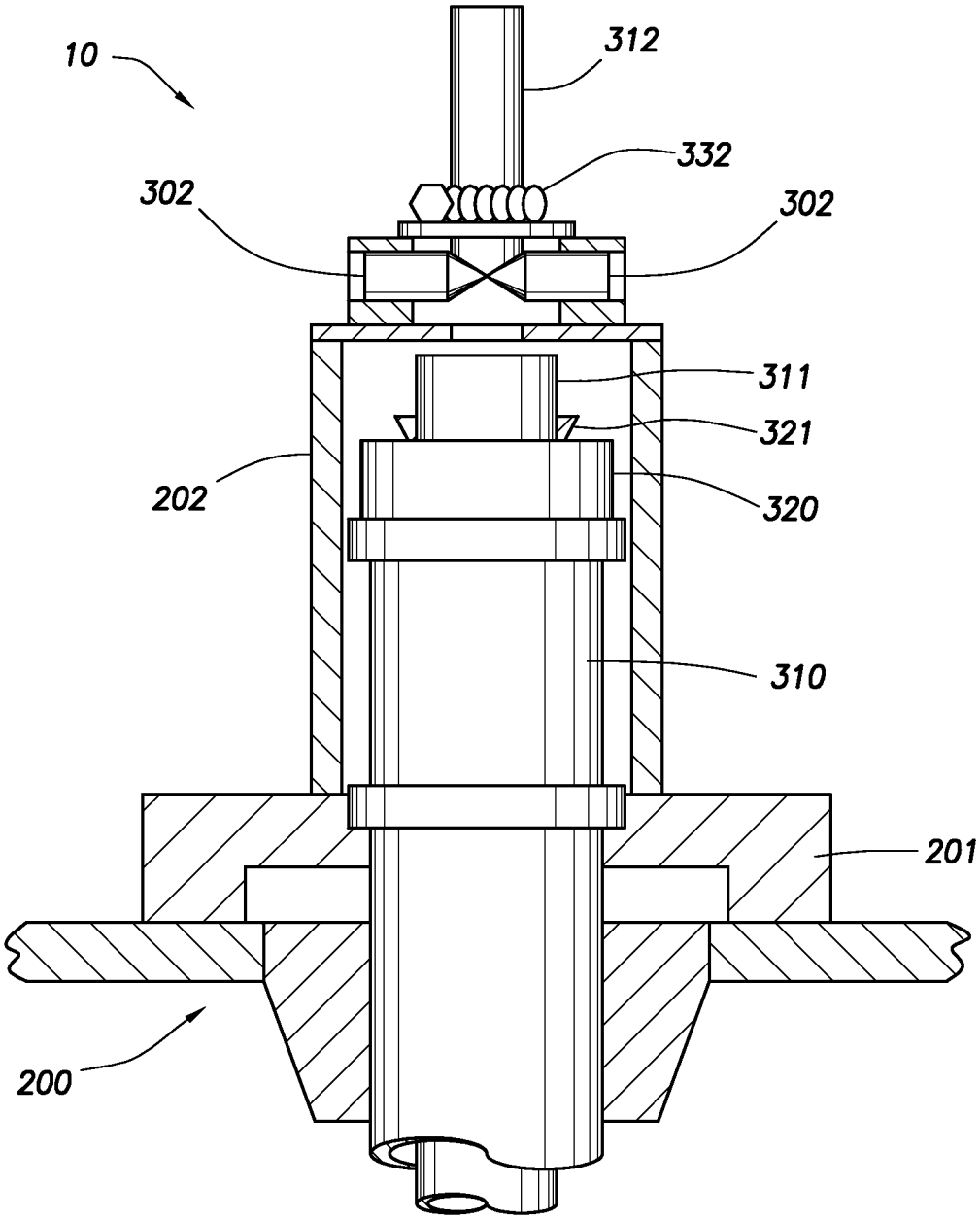

As mentioned above and as illustrated in FIGS. 5A through 5D, the cutting device 302 can be located above the running table 202. According to this embodiment, the cutting device 302 can be used to cut through only one tubing string. For example, depending on the stage of running, the cutting device 302 can either cut through the second tubing string 311 or the third tubing string 312 or a fourth tubing string (not shown) and so on. An example of cutting the second tubing string 311 is shown in FIGS. 5A and 5B. As can be seen, the first tubing string 310 is suspended from the release table 201 and the second tubing string 311 is suspended from the running table 202 via the second safety collar and plate 331. After activation of the cutting device 302, the second tubing string 311 can be severed such that it falls below the BOP 130. An example of cutting the third tubing string 312 is shown in FIGS. 5C and 5D. As can be seen, the first and the second tubing strings 310 and 311 are suspended from the release table 201 and the third tubing string 312 is suspended from the running table 202 via the third safety collar and plate 332. After activation of the cutting device 302, the third tubing string 312 can be severed such that it falls below the BOP 130. The BOP 130 can then be used to cut through the first tubing string 310 or the first and the second tubing strings 310 and 311 upon closing. Alternatively, the first tubing string 310 or the first and the second tubing strings 310 and 311 can be released prior to, or after the step of, activating the cutting device 302 such that the first tubing string 310 or the first and the second tubing strings 310 and 311 fall below the BOP 130, which prevents the BOP 130 from having to cut through any tubing string.

According to an embodiment, a method of controlling a blowout comprises: compressing at least a portion of a second tubing string and a third tubing string together, wherein the step of compressing comprises activating a crimping device; cutting through the wall of at least a third tubing string, wherein the step of cutting comprises activating a cutting device, and wherein the step of cutting is performed after the step of compressing; releasing at least the second tubing string and the third tubing string into a portion of a well system, wherein the step of releasing comprises activating a release table, and wherein the step of releasing at least the second and third tubing strings is performed after the step of cutting; and causing or allowing a blowout preventer to close.

Figure 6A:
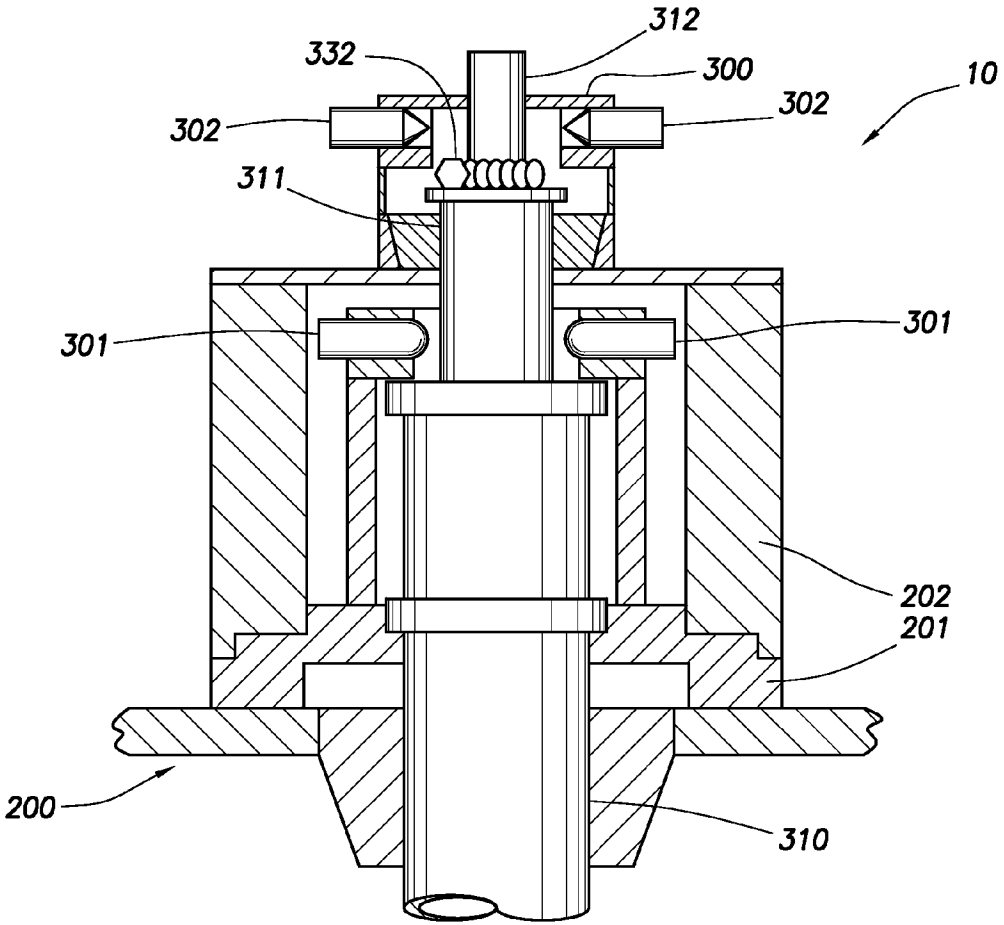
FIGS. 6A and 6B depict a well system including both, the crimping device and the cutting device.
Figure 6B:
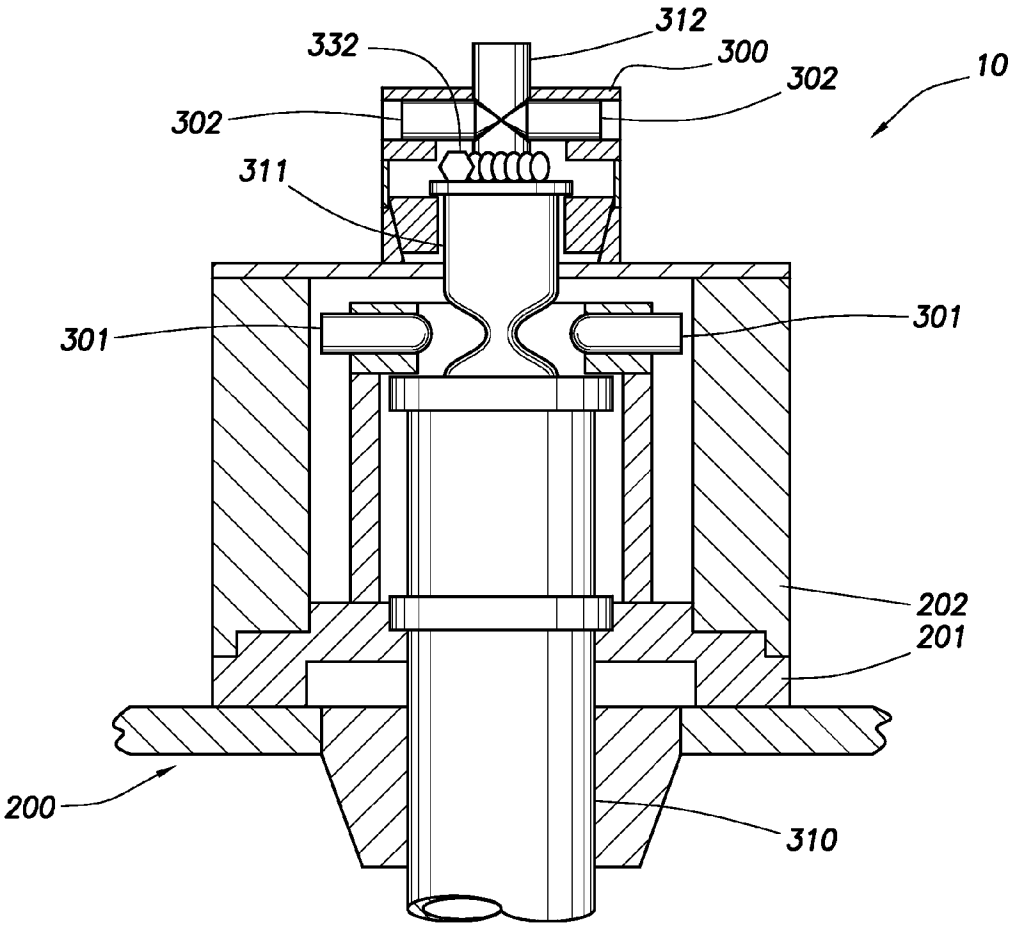

As can be seen in FIGS. 6A and 6B, the well system 10 can include both, the crimping device 301 and the cutting device 302. The inclusion of both devices can be useful when there are three or more tubing strings being run. By compressing at least two tubing strings together, the compressed tubing strings can fall below the BOP 130 as one unit. The crimping device 301 can be located above the top of the first tubing string 310 at a location between the release table 201 and the running table 202. The cutting device 302 can be located above the running table 202. The following scenarios illustrate some of the uses of both devices. The first and the second tubing strings 310 and 311 have been run and the third tubing string 312 is being run. An event occurs which requires shutting in the well. The running of the third tubing string 312 is stopped. The crimping device 301 is activated which compresses the second and third tubing strings 311 and 312 together. The cutting device 302 is activated which severs the third tubing string 312. The second and third tubing strings 311 and 312 are then released via activation of the release table 201. The first tubing string 310 can be released prior to the step of activating the crimping device 301. According to this embodiment, the first tubing string 310 is released first to a point below the BOP 130 and then the second and third tubing strings 311 and 312 are released to a point below the BOP 130. The BOP 130 would not have to cut through any tubing strings upon closing. Alternatively, the first tubing string 310 can be released along with the second and third tubing strings 311 and 312 after the step of cutting.

Therefore, the present invention is well adapted to attain the ends and advantages mentioned as well as those that are inherent therein. The particular embodiments disclosed above are illustrative only, as the present invention may be modified and practiced in different but equivalent manners apparent to those skilled in the art having the benefit of the teachings herein. Furthermore, no limitations are intended to the details of construction or design herein shown, other than as described in the claims below. It is, therefore, evident that the particular illustrative embodiments disclosed above may be altered or modified and all such variations are considered within the scope and spirit of the present invention. While compositions and methods are described in terms of "comprising," "containing," or "including" various components or steps, the compositions and methods also can "consist essentially of" or "consist of" the various components and steps. Whenever a numerical range with a lower limit and an upper limit is disclosed, any number and any included range falling within the range is specifically disclosed. In particular, every range of values (of the form, "from about a to about b," or, equivalently, "from approximately a to b," or, equivalently, "from approximately a to b") disclosed herein is to be understood to set forth every number and range encompassed within the broader range of values. Also, the terms in the claims have their plain, ordinary meaning unless otherwise explicitly and clearly defined by the patentee. Moreover, the indefinite articles "a" or "an", as used in the claims, are defined herein to mean one or more than one of the element that it introduces. If there is any conflict in the usages of a word or term in this specification and one or more patent(s) or other documents that may be incorporated herein by reference, the definitions that are consistent with this specification should be adopted.

What is claimed is:

1. A method of controlling a blowout in a well system having a wellbore, comprising:

releasing at least a first tubing string into the wellbore, wherein the top of the first tubing string is located below a blowout preventer after releasing, wherein the well system includes a second tubing string; and causing or allowing the blowout preventer to close, wherein the step of causing or allowing is performed after the step of releasing.

2. The method according to claim 1, wherein the step of releasing comprises activating a release table, the method further comprising the step of suspending the first tubing string from the release table prior to the step of releasing.

3. The method according to claim 1, wherein the step of releasing comprises activating a release table, the method further comprising the step of indirectly suspending the second tubing string from the release table prior to the step of releasing, wherein the step of indirectly suspending the second tubing string from the release table is performed after the second tubing string has been run.

4. The method according to claim 1, wherein the well system further comprises a running table.

5. The method according to claim 4, wherein the well system further comprises a crimping device.

6. The method according to claim 5, wherein the well system further comprises a third tubing string.

7. The method according to claim 6, further comprising the step of compressing at least a portion of at least the second and third tubing strings together, wherein the step of compressing comprises activating the crimping device.

8. The method according to claim 7, wherein the step of releasing comprises activating a release table, and wherein the crimping device is positioned below the top of the first tubing string and wherein the first tubing string is suspended from the release table.

9. The method according to claim 8, wherein the step of compressing is performed prior to the step of releasing at least the first tubing string.

10. The method according to claim 7, wherein the step of releasing comprises activating a release table, and wherein the crimping device is located above the top of the first tubing string at a location between the release table and the running table.

11. The method according to claim 10, wherein the step of compressing is performed after the step of releasing at least the first tubing string.

12. The method according to claim 11, further comprising the step of releasing the at least the second and third tubing strings after the step of compressing.

13. A method of controlling a blowout comprising:

releasing at least a first tubing string into a wellbore of a well system, wherein the top of the first tubing string is located below a blowout preventer after releasing;

cutting through the wall of at least a second tubing string, wherein the step of cutting comprises activating a cutting device; and causing or allowing the blowout preventer to close, wherein the step of causing or allowing is performed after the step of releasing.

14. The method according to claim 13, wherein the cutting device is designed such that the cutting device is capable of completely cutting through the entire wall circumference of at least two or more tubing strings.

15. The method according to claim 13, wherein the step of cutting is performed prior to the step of releasing at least the first tubing string.

16. The method according to claim 13, wherein the step of cutting is performed after the step of releasing at least the first tubing string.

17. A method of controlling a blowout comprising:

compressing at least a portion of a second tubing string and a third tubing string together, wherein the step of compressing comprises activating a crimping device;

cutting through the wall of at least the third tubing string, wherein the step of cutting comprises activating a cutting device, and wherein the step of cutting is performed after the step of compressing;

releasing at least the second tubing string and the third tubing string into a wellbore of a well system, wherein the tops of the second and third tubing strings are located below a blowout preventer after releasing, and wherein the step of releasing at least the second and third tubing strings is performed after the step of cutting; and causing or allowing the blowout preventer to close, wherein the step of causing or allowing is performed after the step of releasing.

18. The method according to claim 17, wherein the step of releasing further comprises releasing a first tubing string.

19. The method according to claim 17, further comprising the step of releasing at least a first tubing string, wherein the step of releasing at least the first tubing string comprises activating a release table, and wherein the step of releasing at least the first tubing string is performed prior to the step of compressing.

* * * * *